US009976324B1

(12) United States Patent
Edwards

(10) Patent No.: US 9,976,324 B1
(45) Date of Patent: May 22, 2018

(54) AIRCRAFT DOOR LATCH ARM ROTATION LIMITING DEVICE

(71) Applicant: The Boeing Company, Chicago, IL (US)

(72) Inventor: Curtis R. Edwards, Olympia, WA (US)

(73) Assignee: The Boeing Company, Chicago, IL (US)

( * ) Notice: Subject to any disclaimer, the term of this patent is extended or adjusted under 35 U.S.C. 154(b) by 18 days.

(21) Appl. No.: 15/356,606

(22) Filed: Nov. 20, 2016

(51) Int. Cl.
*E05C 19/18* (2006.01)
*E05C 17/54* (2006.01)
(Continued)

(52) U.S. Cl.
CPC ..... *E05C 17/54* (2013.01); *E05B 13/00* (2013.01); *E05B 13/002* (2013.01);
(Continued)

(58) Field of Classification Search
CPC ..... E05C 17/047; E05C 17/36; E05C 17/54; E05C 19/18; E05C 19/184; E05C 19/186; E05C 19/188; E05C 19/003; E05B 13/001; E05B 13/002; E05B 13/007; E05B 65/0894; E05B 65/1093; E05B 2015/1692; E05B 13/00; E05Y 2900/502; Y10S 292/02; Y10S 292/15; Y10S 292/60; Y10T 292/03; Y10T 292/087; Y10T 292/34; Y10T 292/37; Y10T 292/373; Y10T 292/376; Y10T 292/379; Y10T 292/382; Y10T 292/385; Y10T 292/388; Y10T 292/391; Y10T 292/394; Y10T 292/397; Y10T 292/65; Y10T 292/67;
(Continued)

(56) References Cited

U.S. PATENT DOCUMENTS 765,658 A * 7/1904 Beseler ..... E05C 19/18 292/258
1,125,982 A * 1/1915 Dufala ..... B62D 33/0273 296/57.1
(Continued)

FOREIGN PATENT DOCUMENTS

DE 4311805 A1 * 10/1994 ..... E05B 13/002
DE 9412385 U1 * 12/1994 ..... E05C 17/047
(Continued)

*Primary Examiner* — Christine M Mills
(74) *Attorney, Agent, or Firm* — Felix L. Fischer

(57) ABSTRACT

An aircraft door latch arm rotation limiting device incorporates a flexible strap having a proximal end and distal end. The distal end is insertable through a loop eye proximate to an aircraft door. An elongate sleeve is disposed on the proximal end of the flexible strap and the sleeve is received over a rotatable latch arm of an aircraft door. A first receiving element intermediate the proximal and distal ends of the flexible strap releasably engages the distal end of the flexible strap to establish a first predetermined looped strap length restricting rotation of the lever beyond a partially open position. A second receiving element is disposed between the first receiving element and the proximal end on the flexible strap to releasably engage the distal end to establish a second predetermined looped strap length preventing rotation of the lever from a closed position.

18 Claims, 12 Drawing Sheets

(51) Int. Cl.
*E05B 13/00* (2006.01)
*E05B 65/08* (2006.01)
*E05B 15/16* (2006.01)

(52) U.S. Cl.
CPC ..... *E05B 13/007* (2013.01); *E05B 65/0894* (2013.01); *E05C 19/18* (2013.01); *E05C 19/184* (2013.01); *E05B 2015/1692* (2013.01); *E05Y 2900/502* (2013.01); *Y10S 292/15* (2013.01); *Y10S 292/60* (2013.01); *Y10T 292/03* (2015.04); *Y10T 292/087* (2015.04); *Y10T 292/34* (2015.04); *Y10T 292/65* (2015.04); *Y10T 292/67* (2015.04)

(58) Field of Classification Search
CPC ..... Y10T 24/318; Y10T 24/3404; Y10T 24/2708; Y10T 16/61; Y10T 292/28
USPC ..... 292/1, 246, 288, 289–298, 338, 339, 292/DIG. 2, DIG. 15, DIG. 60, 262; 248/351
See application file for complete search history.

(56) References Cited

U.S. PATENT DOCUMENTS 3,147,030 A * 9/1964 Berk ..... E05B 65/0014 24/601.4
4,070,049 A * 1/1978 Brewer ..... E05C 19/004 292/263
4,188,061 A * 2/1980 Shehi ..... E05C 17/36 296/76
4,756,052 A * 7/1988 Diedrich ..... E05C 17/54 16/82
4,860,408 A * 8/1989 Johnson ..... B60P 7/0823 24/122.3
5,517,838 A * 5/1996 Moore ..... E05B 13/002 24/16 PB
5,620,215 A * 4/1997 Janeway ..... E05B 65/0888 292/256
5,647,619 A * 7/1997 DeLisio ..... E05C 17/36 292/262
6,059,231 A * 5/2000 Dessenberger, Jr. . B64C 1/1407 244/129.5
6,311,367 B1 * 11/2001 Larsen ..... E05F 3/221 16/375
6,422,794 B1 * 7/2002 Zhan ..... B61D 45/003 410/100
6,648,381 B2 * 11/2003 Holton ..... E05C 17/042 24/298
7,175,213 B1 * 2/2007 Blangiardo ..... E05B 13/002 292/1
7,325,281 B1 * 2/2008 Willems ..... B60R 25/00 24/302
8,075,038 B2 * 12/2011 Zielinsky ..... B62D 33/0273 16/82
8,616,593 B2 * 12/2013 Bruce ..... E05C 17/042 24/298
2004/0183315 A1 * 9/2004 O'Donohoe ..... E05B 13/001 292/288
2007/0085352 A1 * 4/2007 Ulanday ..... E05C 17/365 292/288
2011/0133494 A1 * 6/2011 Hopkins ..... E05C 19/18 292/253
2013/0056998 A1 * 3/2013 Chincarini, Jr. ..... E05C 17/36 292/262
2015/0204122 A1 * 7/2015 Edwards ..... E05C 19/184 292/288
2016/0237725 A1 * 8/2016 Raffi ..... E05C 7/04

FOREIGN PATENT DOCUMENTS

FR 2835559 B1 * 9/2004 ..... E05C 17/047
GB 705900 A * 3/1954 ..... E05B 13/002

* cited by examiner

AIRCRAFT DOOR LATCH ARM ROTATION LIMITING DEVICE

BACKGROUND INFORMATION

Field

Embodiments of the disclosure relate generally to operation of aircraft doors and more particularly to an adjustable lead received through a restraining element and attached to a sleeve received over an aircraft door latch arm to limit rotation of the arm.

Background

Aircraft doors have multiple position latching systems due to the complex requirements for sealing a pressurized cabin. Sometimes it is necessary to have an aircraft door open (at least partially) for added ventilation during manufacturing and maintenance activities or to feed electrical test cables or other equip hookup facilities through a small opening, to accommodate system operation and functional test requirements. These conditions with the door partially open may create a falling hazard to those working inside the aircraft near the door way. The conventional solution is to place scaffolding or other devices outside the door at the same level as the door step. This equipment is expensive and these solutions are time-consuming to put into place and remove. In some cases placing this equipment near the aircraft conflicts with other equipment that needs to be in the same space.

At other times, it is necessary to temporarily prevent an aircraft door from being opened, even partially, to avoid injury to individuals working on the exterior of the aircraft, near the door, or to avoid damage to equipment placed just outside the door. The conventional solution is to place a sign, interior to the aircraft, on the door, indicating that the door should not be opened. In some cases it may not be convenient to create or place a sign. In other cases, signs attached to the door may inadvertently be removed or fall off due to humidity, fans, or work going on in the aircraft.

Prior art devices for door restraint are typically bolted onto the door and door portal to limit the angle of travel for the door. These devices require dedicated bolt holes in the door and portal or other specific attachment mechanisms.

SUMMARY

Exemplary embodiments disclosed herein provide an aircraft door latch arm rotation limiting device incorporating a flexible strap having a proximal end and distal end. The distal end is configured to be inserted through a loop eye proximate to an aircraft door. An elongate sleeve is disposed on the proximal end of the flexible strap and the sleeve is configured to be received over a rotatable latch arm of an aircraft door. A first receiving element is disposed intermediate the proximal and distal ends of the flexible strap. The first receiving element releasably engages the distal end of the flexible strap when looped through the loop eye to establish a first predetermined looped strap length restricting rotation of the lever beyond a partially open position. A second receiving element is disposed between the first receiving element and the proximal end on the flexible strap. The second receiving element releasably engages the distal end when looped through the loop eye to establish a second predetermined looped strap length preventing rotation of the lever from a closed position.

The embodiments provide a method for restraining rotation of a latch lever to limit aircraft door position wherein a sleeve attached to a proximal end of a flexible strap is engaged over a door latch arm. A distal end of the strap is looped through a loop eye. A first receiving element is engaged with the distal end of the strap establishing a first predetermined looped length of the flexible strap and rotation of the door latch arm is restrained beyond a partially opened position.

BRIEF DESCRIPTION OF THE DRAWINGS

The features, functions, and advantages that have been discussed can be achieved independently in various embodiments of the present invention or may be combined in yet other embodiments further details of which can be seen with reference to the following description and drawings.

DETAILED DESCRIPTION

Figure 1A:
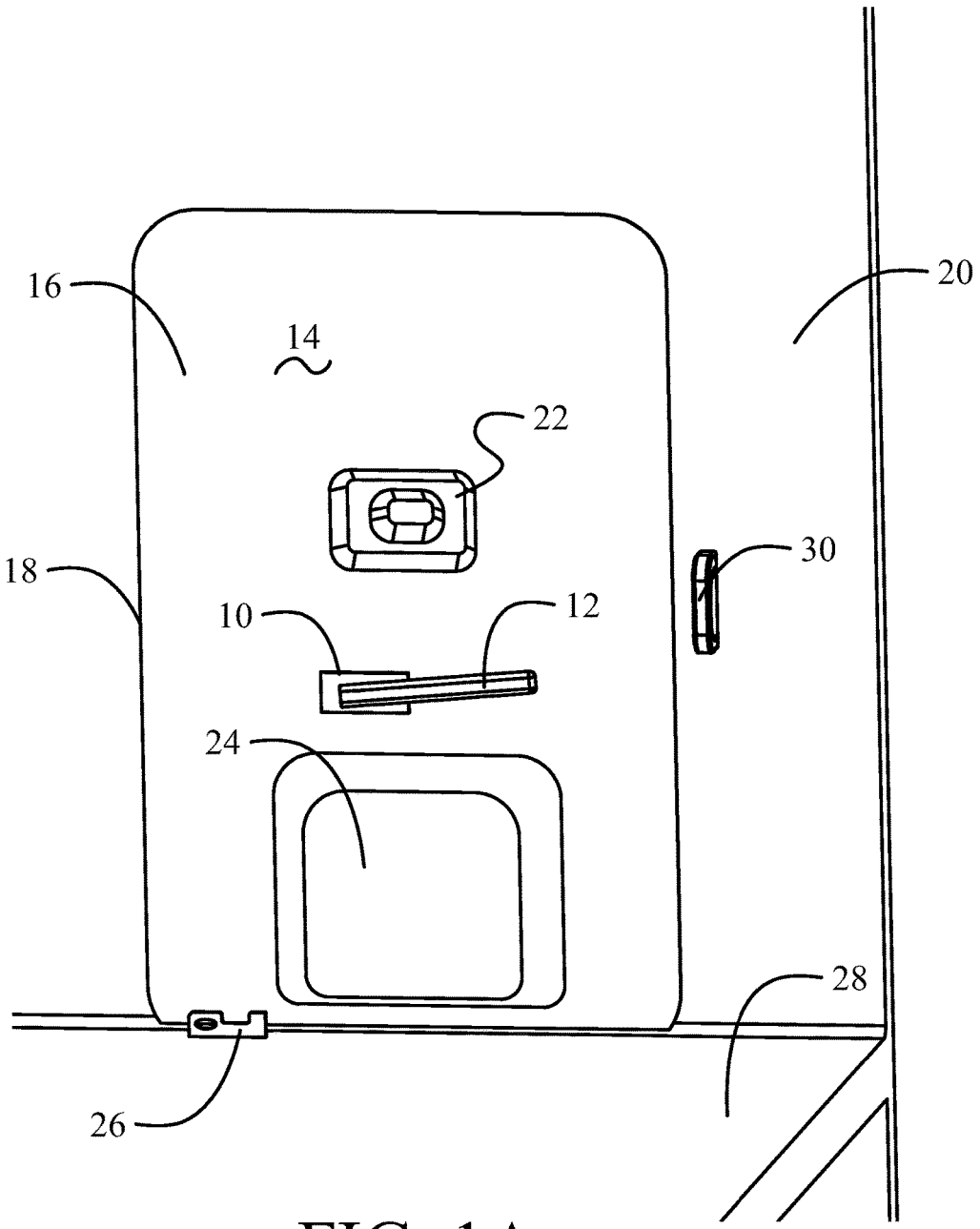
FIG. 1A is a pictorial representation of an exemplary aircraft door and aircraft cabin entry area.
Figure 1B:
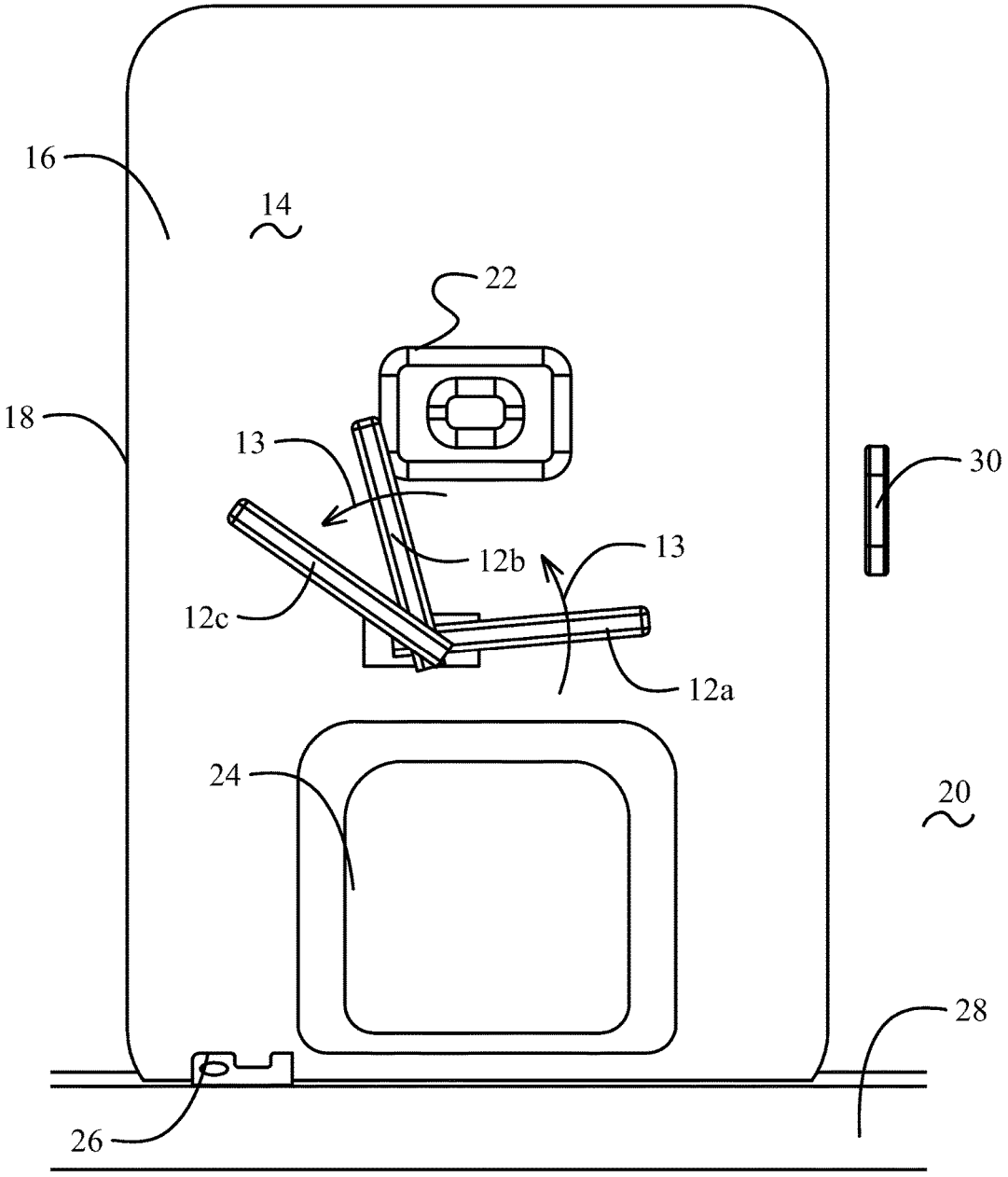
FIG. 1B is a representation of the door latch arm positions for closed, partially open and open for the aircraft door of FIG. 1A.

The embodiments herein provide embodiments for an aircraft door latch arm rotation limiting device to constrain an aircraft door latch arm in a closed or partially open position. Aircraft doors are sophisticated structures due to the requirement for pressurization of the aircraft cabin. The door is typically received in a portal and the door and portal may be contoured to resist expulsion of the door through the portal when the cabin is pressurized. To open the door, typically the door must initially move inward into the cabin to disengage from the portal to a first or partially open position and then rotate through the portal to an open position. Although there are various designs for aircraft doors and their mechanisms, a common design includes a door latch 10 with an arm 12 on the interior side 14 of a door 16 resting in a portal 18 in a fuselage wall 20 as seen in FIG. 1A. The general arrangement of the aircraft door 16 includes a window 22 and, in larger aircraft, an emergency slide 24 which has an attachment bracket 26 in the cabin floor 28. A grab handle 30 is typically present on the cabin wall adjacent the door 16 for use by the cabin crew. In certain configurations a door assist handle may be located on the door itself to be used coordinated with the grab handle adjacent to the door, to leverage the door inward, during the door closure process. As shown in FIG. 1B, the arm 12 rotates as shown by arrows 13 between a first position (designated 12*a*) that locks the door closed, and a second position (designated 12*b*) that allows the door to move to the partially opened position, and a third position (designated 12*c*) that allows the door to be fully opened.

Figure 2:
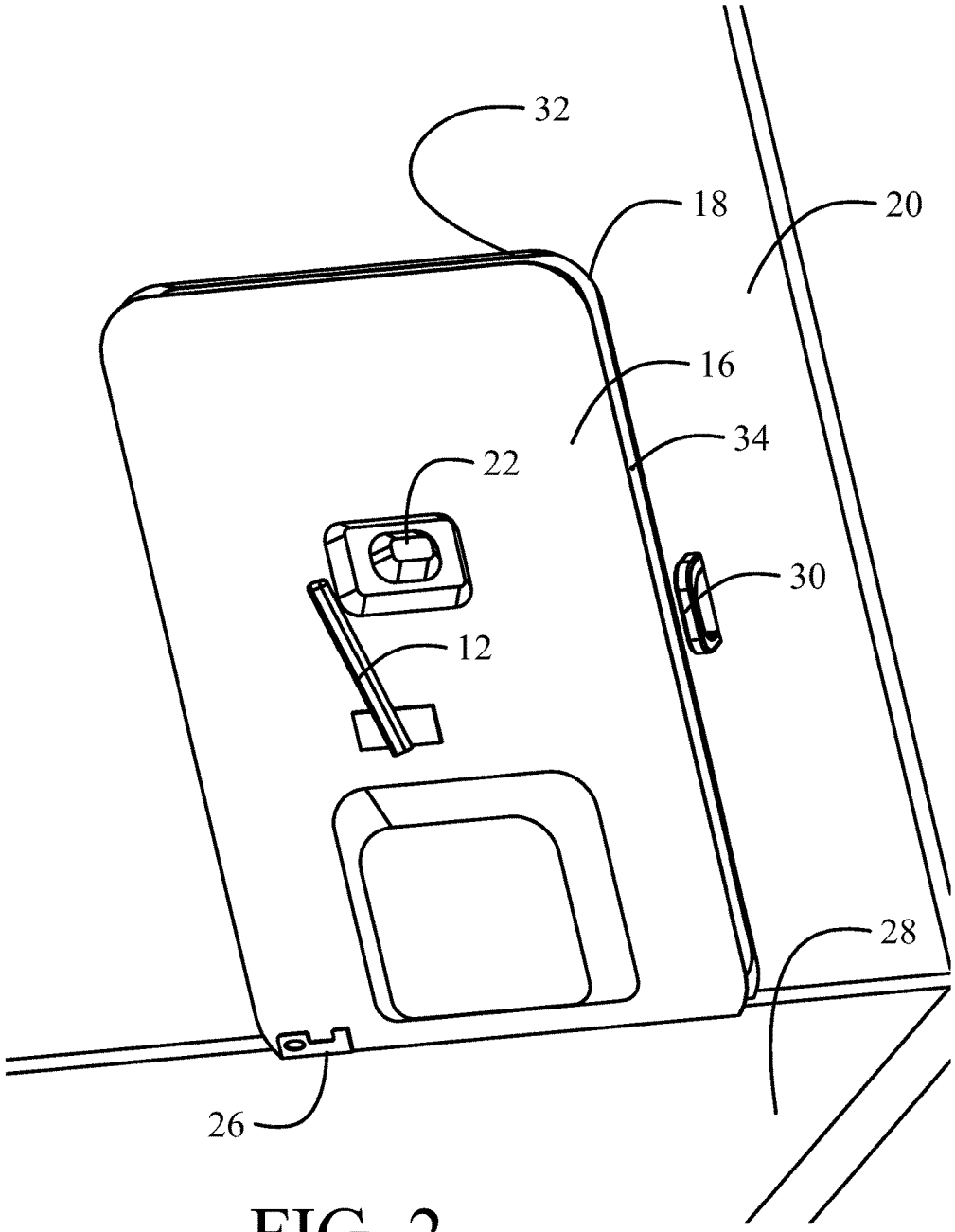
FIG. 2 is a pictorial representation of the aircraft door of FIG. 1 in the partially opened position.

With the door latch arm 12 in the partially open position, the door 16 is drawn slightly into the cabin to disengage from the portal 18 as seen in FIG. 2. This position allows ventilation of the cabin through the gap 32 between a periphery 34 of the door and the portal 18.

Figure 3:
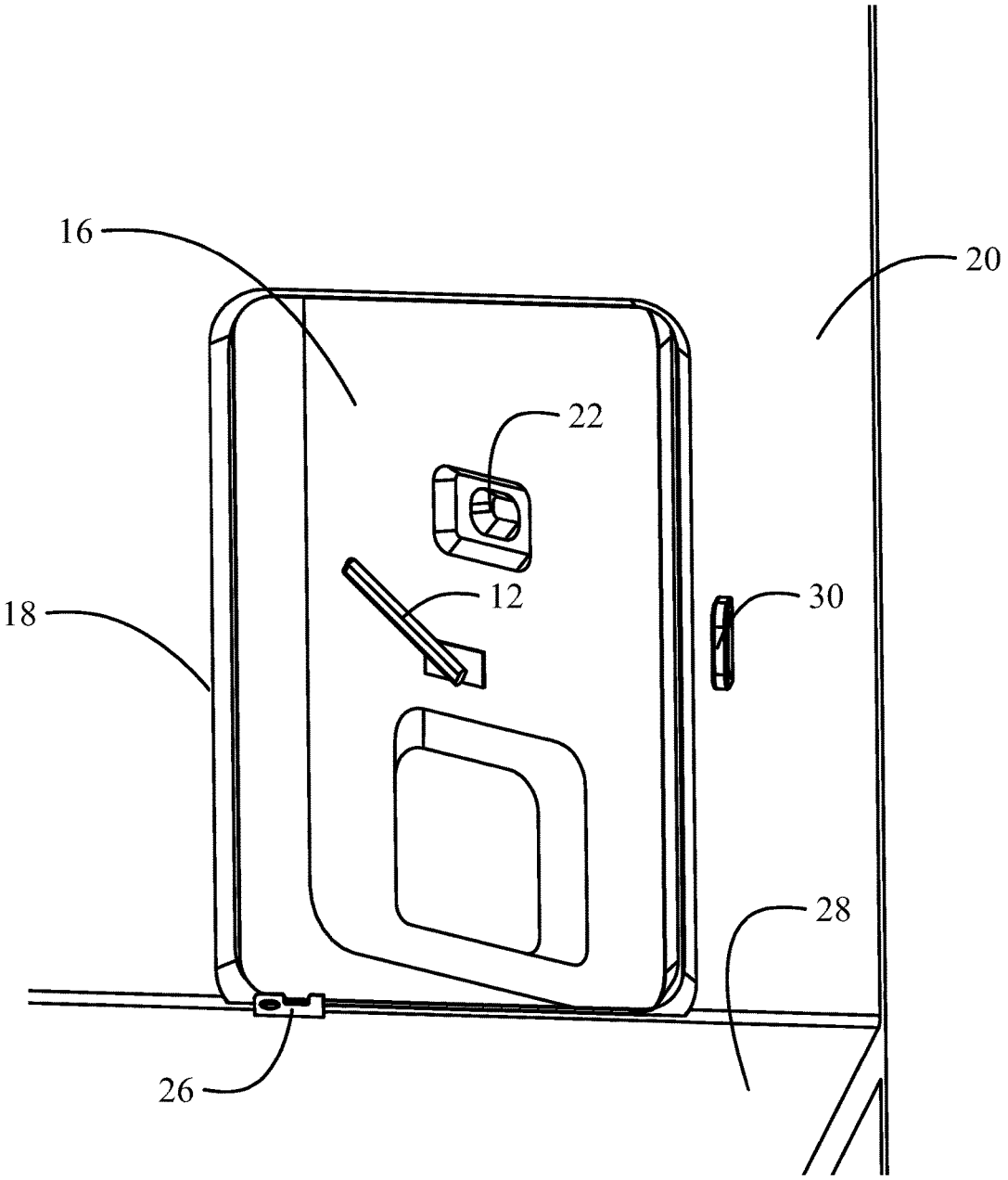
FIG. 3 is a pictorial representation of the aircraft door of FIG. 1 in the opened position with the door in transit to the fully open position.

As seen in FIG. 3, with the door latch arm 12 in the open position, the door 16 may then rotate through the portal 18 and about a pivot axis external to the aircraft fuselage wall 20.

Figure 4:
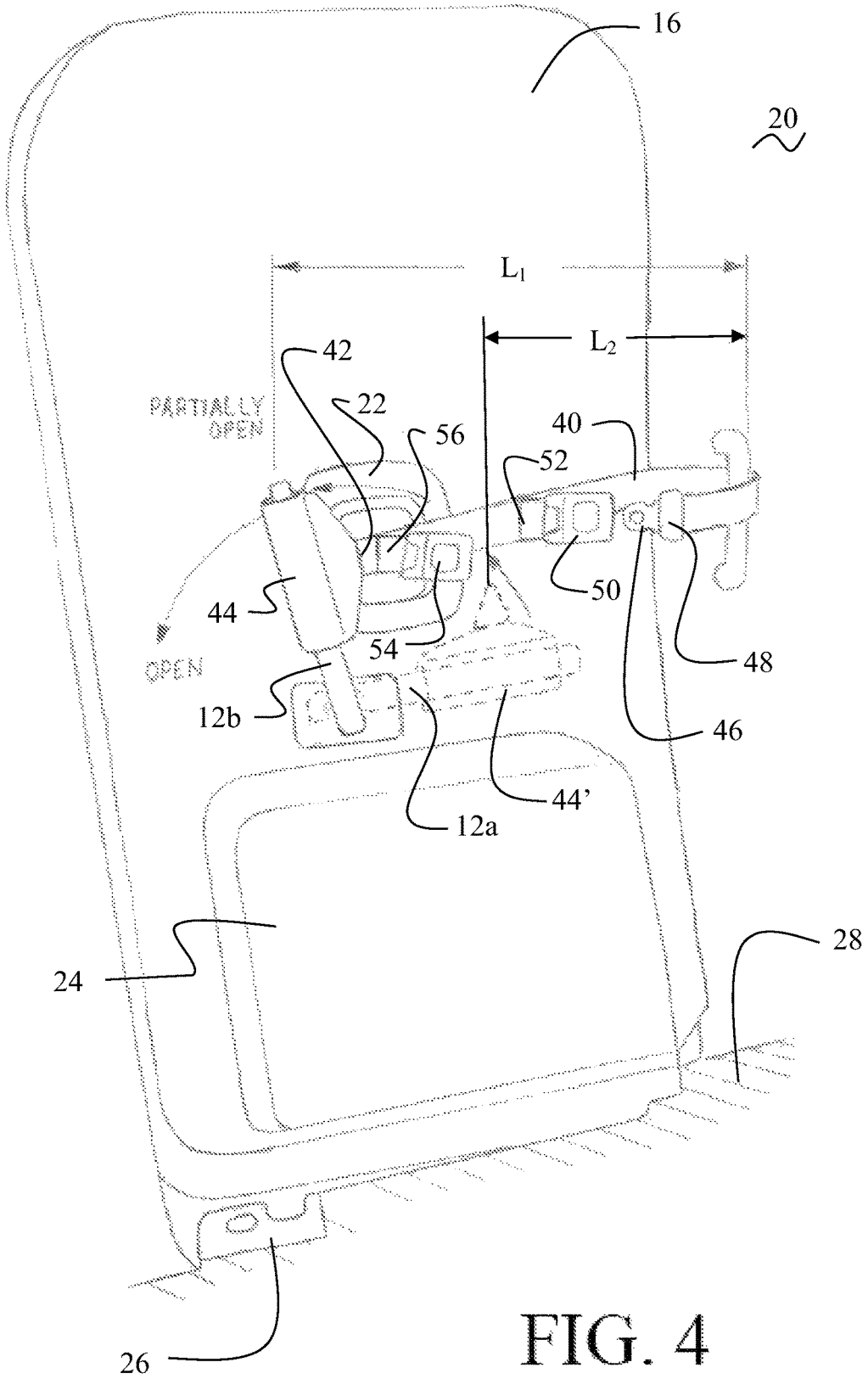
FIG. 4 is a pictorial representation the aircraft door of FIG. 1 in the partially opened position with a first embodiment of the latch arm rotation limiting device demonstrated.

A first embodiment of the aircraft door latch arm rotation limiting device is shown in FIG. 4. A flexible strap 40 is engaged to the door latch arm 12 at a proximal end 42 with an elongated sleeve 44 which receives the arm 12. A strap securing element 46 is attached to a distal end 48 of the strap 40 and is configured to be received through the grab handle 30 (or the door assist handle previously described), as a loop eye, and looped back for attachment to a first receiving element 50 engaged to the strap at a first position 52 intermediate the proximal and distal ends. With the securing element 46 engaged in the first receiving element 48, a first predetermined looped strap length L1 is established which limits rotation of the door latch arm to the partially opened position 12*b* as previously described. For the first embodiment, the securing element and receiving element are a blade having an engagement aperture and receiving buckle having a releasable internal capture pawl to engage the aperture similar to a standard seat belt buckle.

Figure 5:
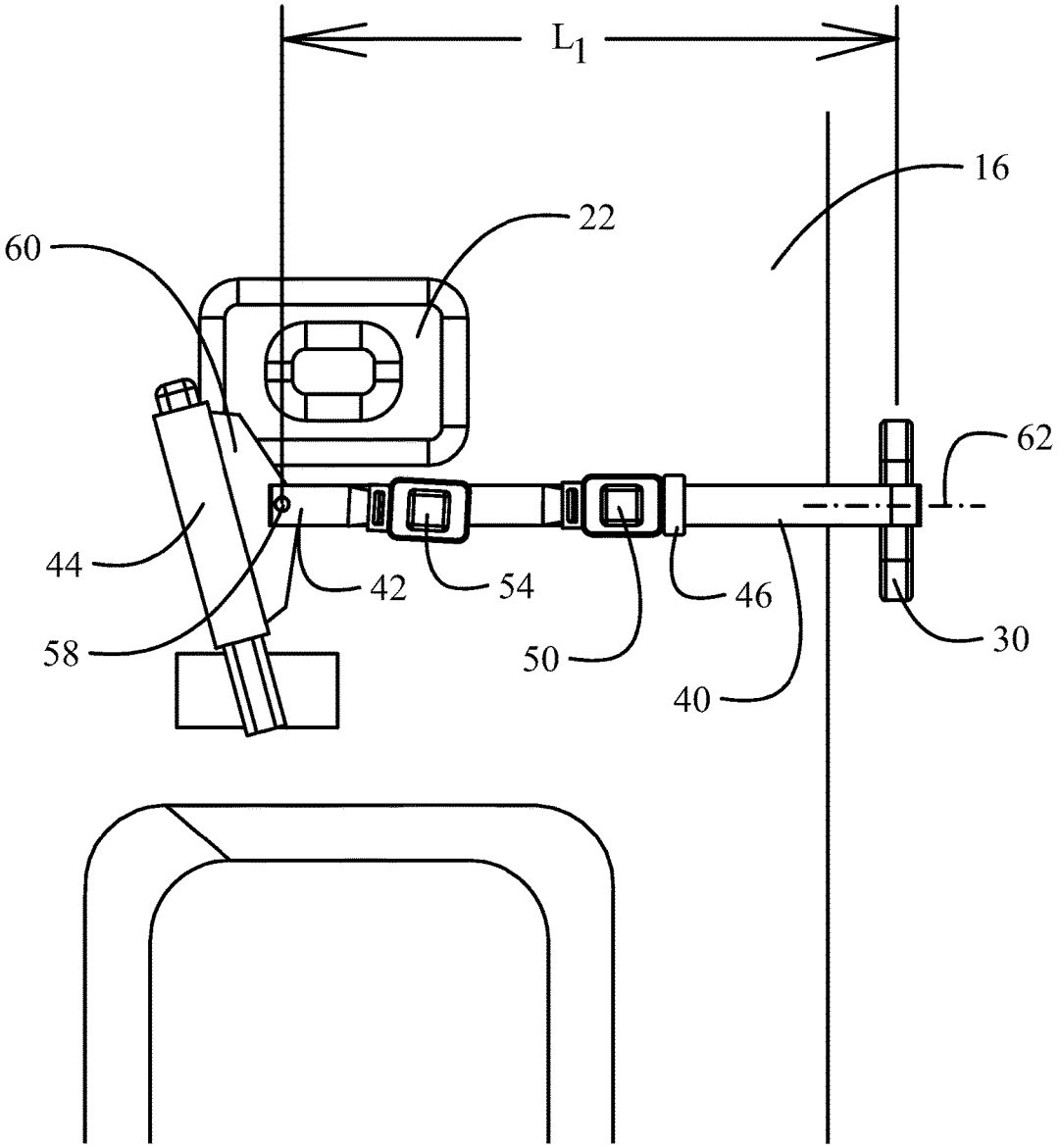
FIG. 5 is a detailed representation of the first embodiment constraining the latch arm in the partially opened position.

The first embodiment with the securing element engaged in the first receiving element is shown in detail in FIG. 5. A pivot pin 58 may be employed to engage the proximal end 42 of the strap 40 to a flap 60 extending from the sleeve 44 to allow flexible alignment of the sleeve and strap in multiple positions. As seen in FIG. 5, with the strap in the first predetermined length and the door latch arm 12 in the partially opened position, the sleeve 44 is transverse to a longitudinal axis 62 of the strap 40.

Returning to FIG. 4, a second receiving element 54 is alternatively engaged to the securing element 46 on the strap 40 at a second position 56 between the first position 52 and the proximal end 42 of the strap. By engaging the securing element 46 in the second receiving element 54 a second predetermined looped strap length L2 is established which prevents rotation of the door latch arm from the closed position 12*a* as shown in phantom with the sleeve 44' in FIG. 4.

Figure 6A:
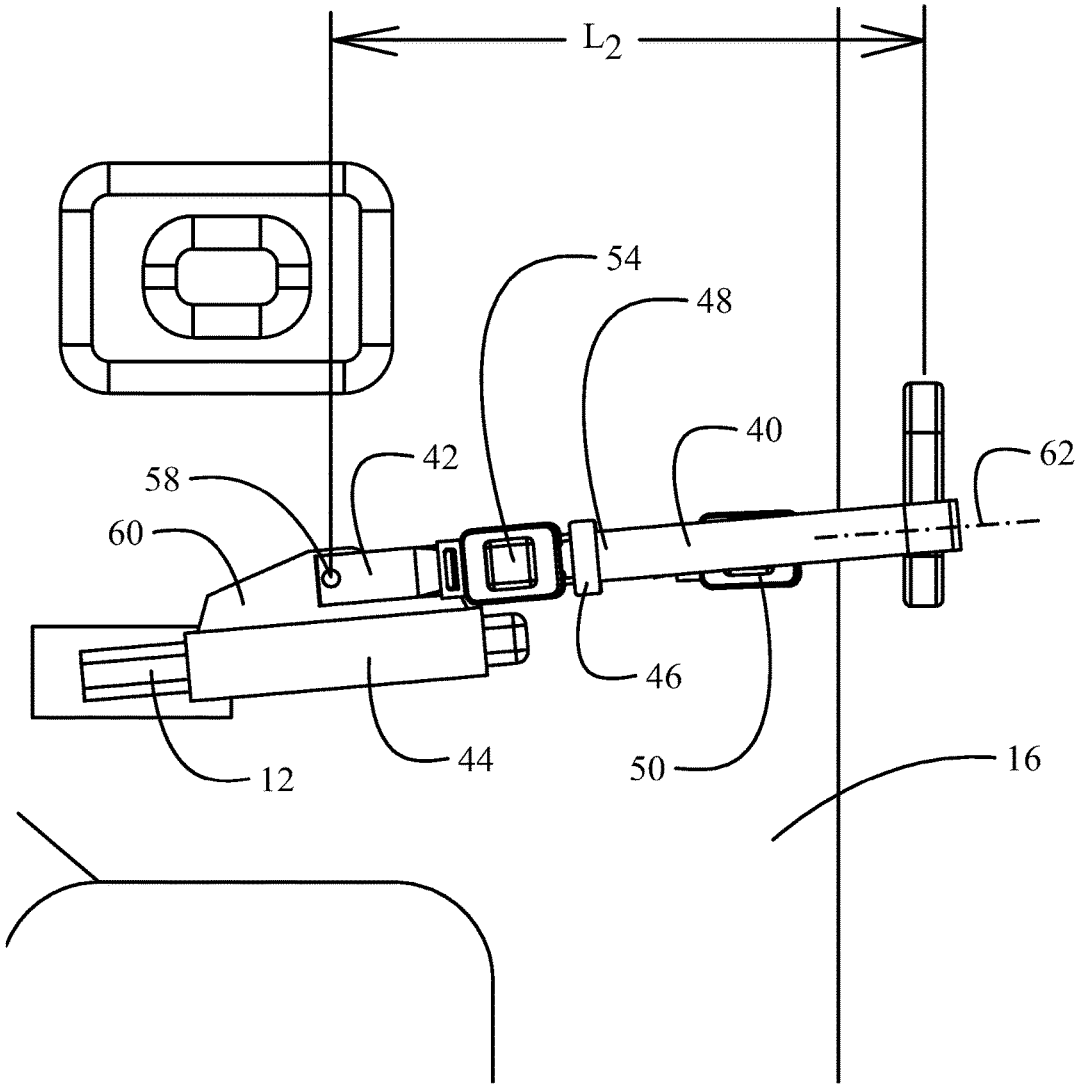
FIG. 6A is a detailed representation of the first embodiment constraining the latch arm in the closed position.
Figure 6B:
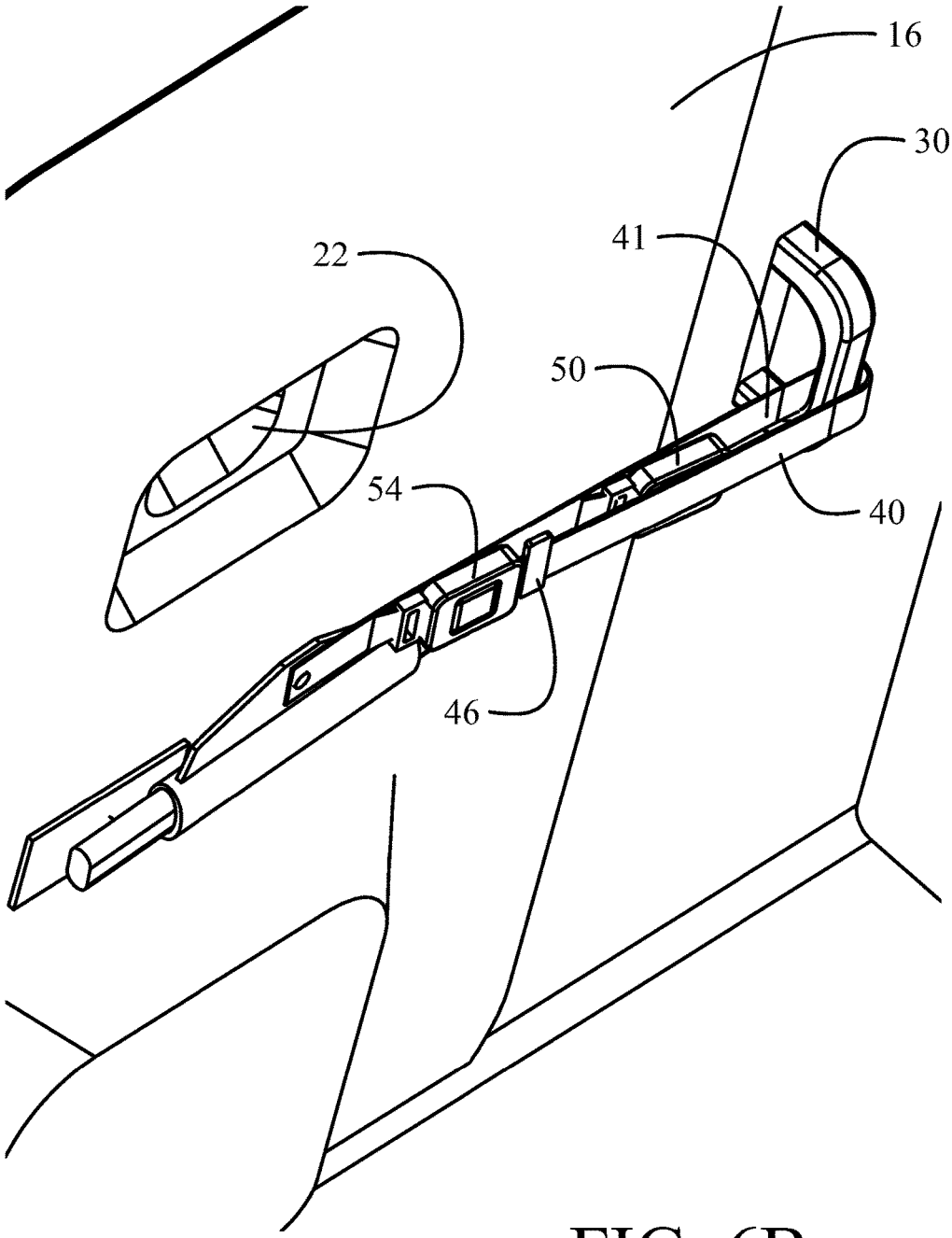
FIG. 6B is an alternative view of the first embodiment of FIG. 6A.

FIGS. 6A and 6B show in detail the strap 40 with the securing element 46 engaged in the second receiving element 54 to create the second predetermined strap length L2. The strap 40 extends past the first receiving element 50 with the receiving element 50 encircled by the strap loop 41 as seen in FIG. 6B. In alternative embodiments, the first and second receiving elements may be on opposite sides of the strap and the strap looped oppositely through the grab handle 30 for the first or second desired length. As seen in the drawings, when engaged in the second receiving element 54 and the handle 12 in the closed position the strap 40 and sleeve 44 are rotated at the pivot pin 58 and the sleeve is substantially parallel to the strap axis 62.

While the strap 40 is shown as looping through a grab 30 handle for the described embodiments herein, a pad eye or similar structure attached to the cabin wall or door may be employed as the loop eye for the strap.

Figure 7:
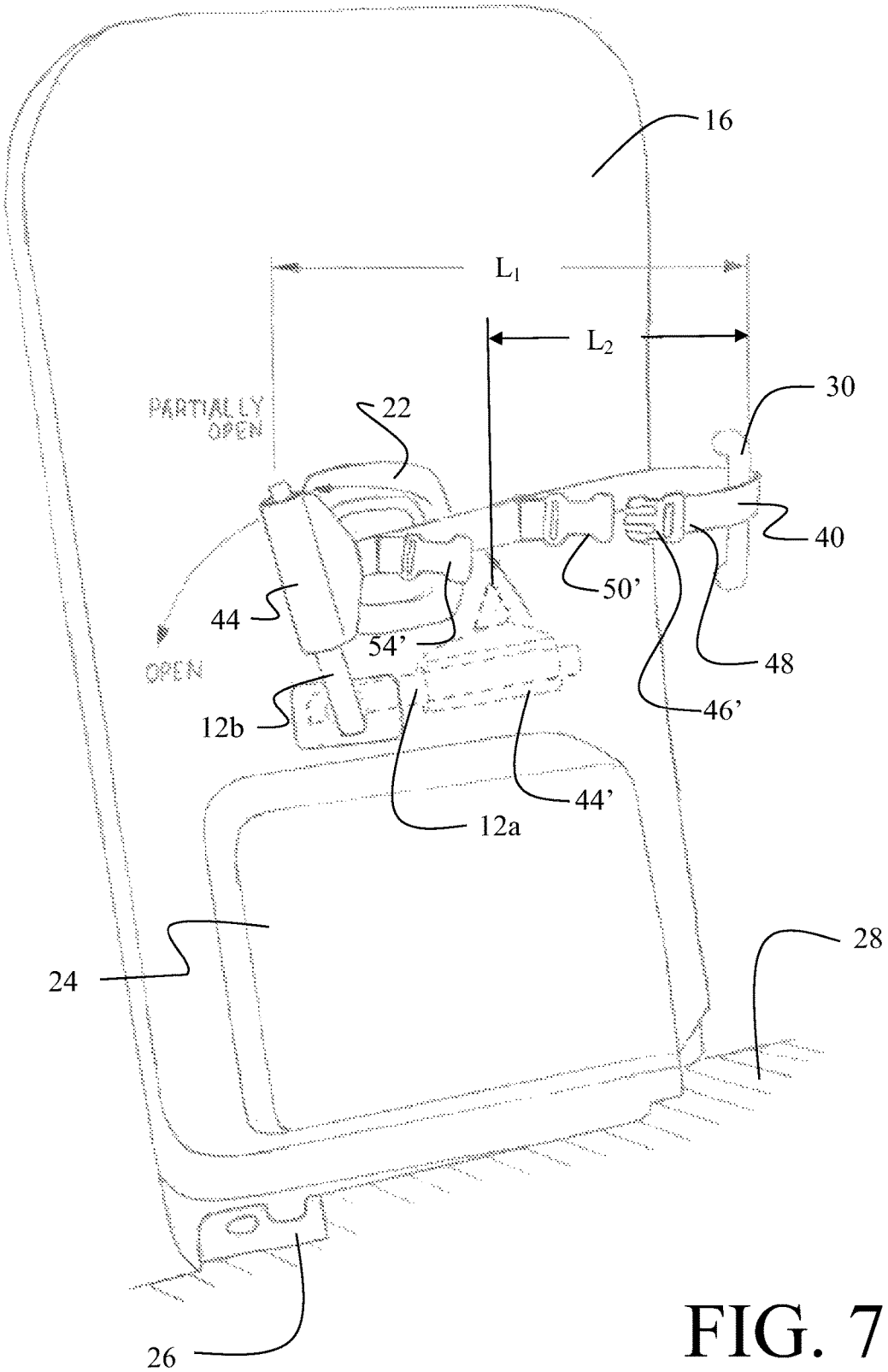
FIG. 7 is a pictorial representation the aircraft door in the partially opened position with a second embodiment of the latch arm rotation limiting device demonstrated.
Figure 8:
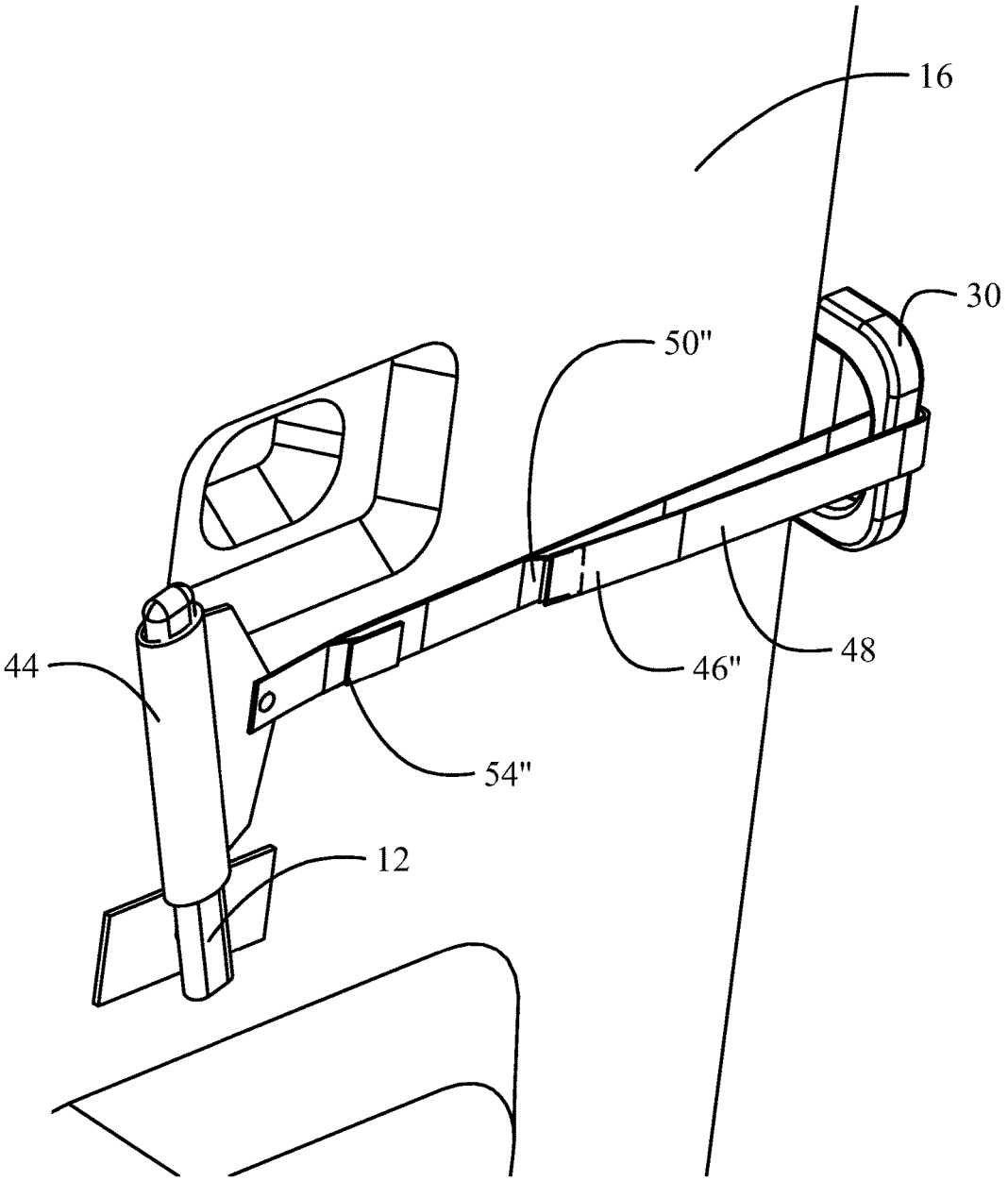
FIG. 8 is a detailed representation of a third exemplary embodiment of the latch arm rotation limiting device.

FIG. 7 shows a second embodiment in which the first receiving element 50' and second receiving element 54' side-squeeze strap buckles and the securing element 46' is joining pair of side squeeze tabs. FIG. 8 shows a third embodiment in which the first receiving element 50" and second receiving element 54" are tabs with hook or loop fastening moieties while the securing element 46" is a tab secured to the strap distal end 48 with the mating hook or loop fastening moiety. Hook and eye fasteners or button snaps may also be employed in comparable embodiments.

Figure 9:
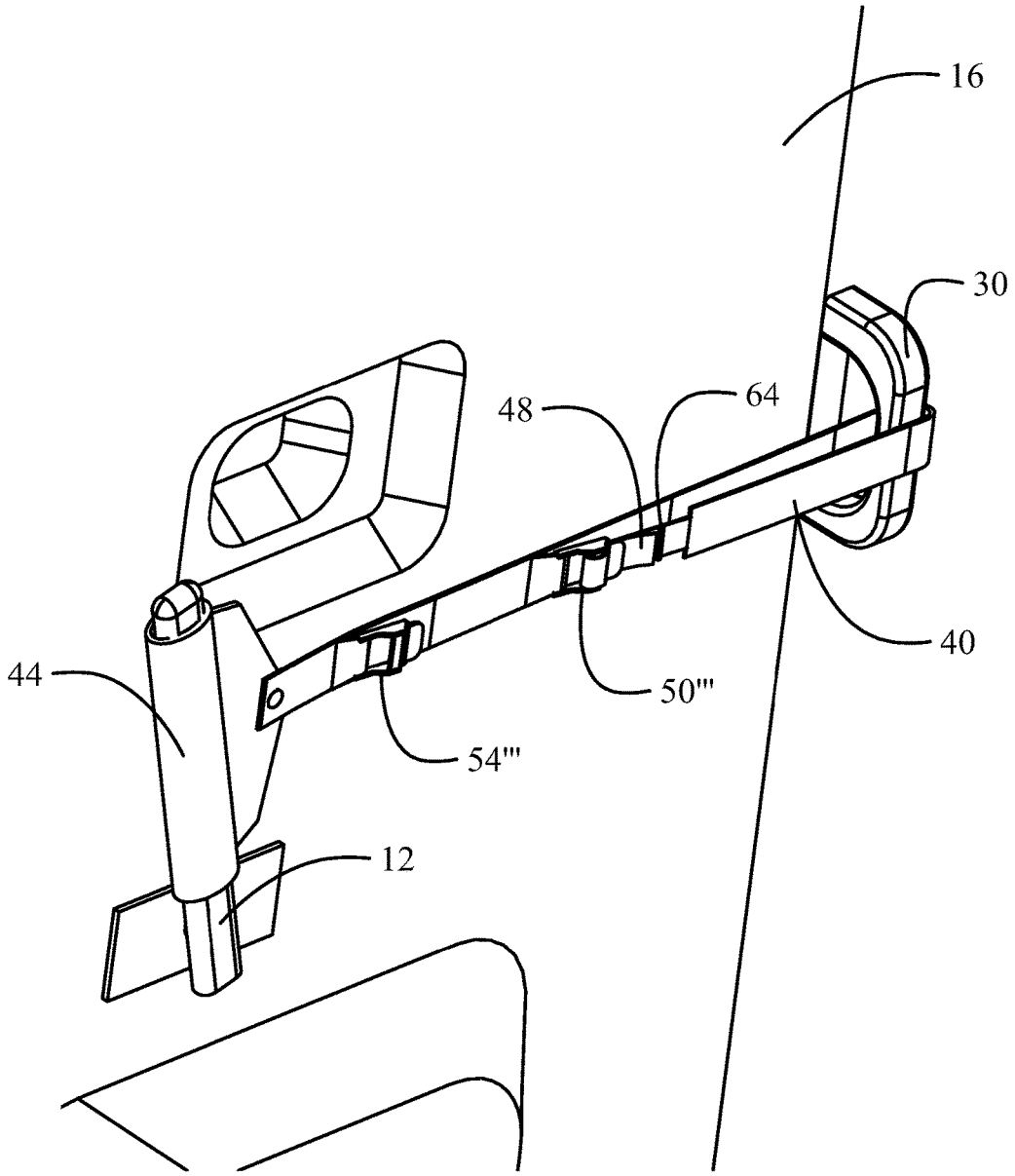
FIG. 9 is a detailed representation of a fourth exemplary embodiment of the latch arm rotation limiting device.

FIG. 9 demonstrates a fourth embodiment wherein the first receiving element 50''' and the second receiving element 54''' are ladder lock buckles through which the distal end 48 of the strap 40 is laced and tightened to secure the strap and buckle. An indicia 64 on the strap proximate each receiving element may be employed to identify the appropriate secured length of the distal end through the ladder lock buckle to achieve the predetermined length.

Figure 10:
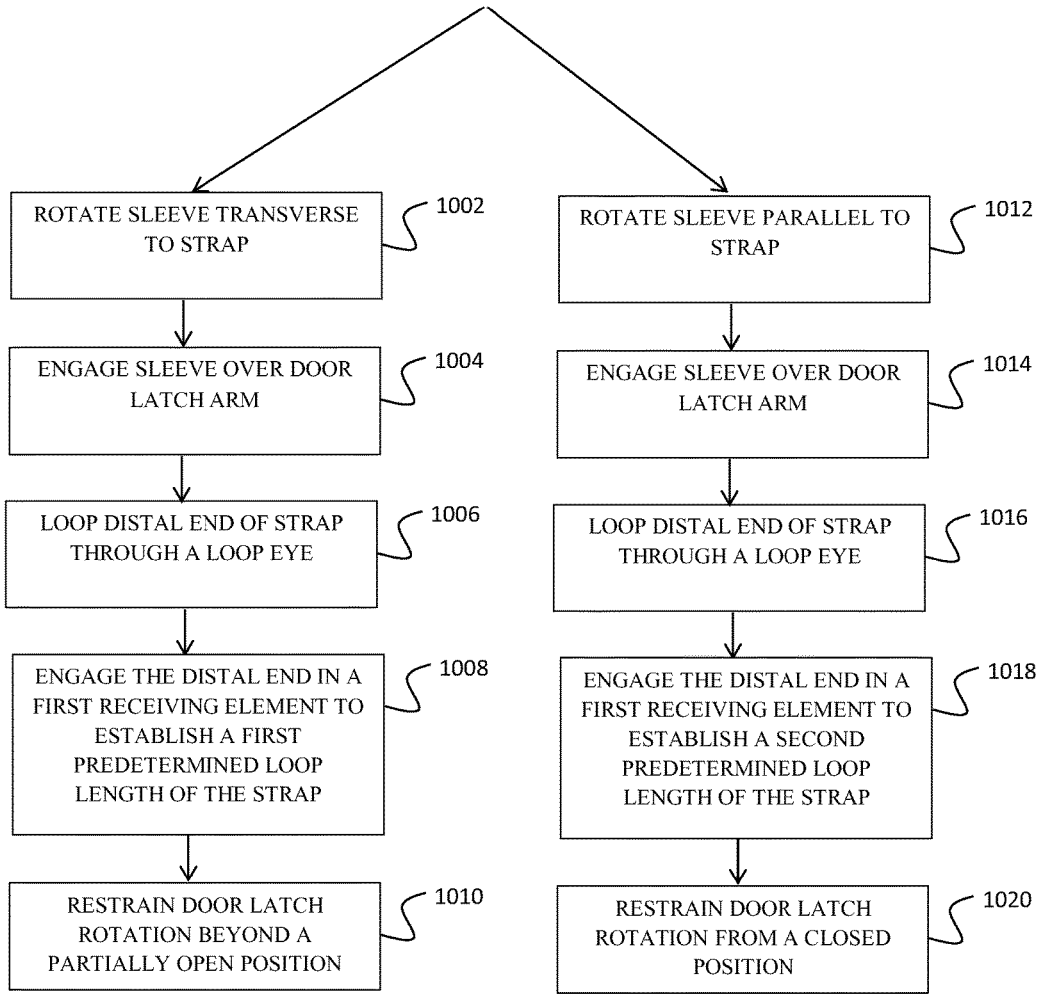
FIG. 10 is a flow chart demonstrating a method for employing the embodiments disclosed herein.

The embodiments for the aircraft door latch arm rotation limiting device as described herein provide a method for control of an aircraft door position as shown in FIG. 10. A sleeve 44 attached to a proximal end of a flexible strap 40 is rotated transverse to the strap axis, step 1002 and the sleeve engaged over the door latch arm 12, step 1004. The distal end 48 of the strap is looped through a loop eye, such as the grab handle 30, step 1006, and engaged by a first receiving element 50, establishing a first predetermined looped length of the flexible strap, step 1008, restraining rotation of the door latch arm beyond a partially opened position, step 1010. Alternatively, the sleeve 44 may be rotated substantially parallel to the strap axis, step 1012, and the sleeve engaged over the door latch arm 12, step 1014. The distal end 48 of the strap is looped through a loop eye, such as the grab handle 30, step 1016, and engaged by a second receiving element 54, establishing a second predetermined looped length of the flexible strap, step 1018, restraining rotation of the door latch arm from a closed position, step 1020.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A system for limiting rotation of an aircraft door latch arm, said system comprising:

an aircraft door having a rotatable latch arm having a first position that locks the aircraft door closed, and a second position that allows the door to move to a partially opened position, and a third position that allows the door to be fully opened;

a flexible strap having a proximal end and a distal end, said distal end having a securing element configured to be inserted through a loop eye on a cabin wall adjacent the aircraft door;

a single elongate sleeve rotatably attached to the proximal end of the flexible strap such that the single elongate sleeve rotates relative to the proximal end of the flexible strap, said single elongate sleeve configured to be received over the rotatable latch arm of the aircraft door;

a first receiving element disposed at a first position on the flexible strap intermediate the proximal end and the distal end of the flexible strap, said first receiving element releasably engaging the securing element on the distal end of the flexible strap when looped through the loop eye, wherein when the securing element is looped through the loop eye and engaged with the first receiving element with the single elongate sleeve received over the rotatable latch arm of the aircraft door, the flexible strap establishes a first predetermined looped strap length restricting rotation of the rotatable latch arm beyond the second position; and a second receiving element disposed at a second position on the flexible strap between the first receiving element and the proximal end on the flexible strap, releasably engaging the securing element on the distal end when looped through the loop eye, wherein when the securing element is looped through the loop eye and engaged with the second receiving element with the single elongate sleeve received over the rotatable latch arm of the aircraft door, the flexible strap establishes a second predetermined looped strap length preventing rotation of the rotatable latch arm beyond the first position.

2. The system of claim 1 wherein the single elongate sleeve is disposed on the proximal end transverse to a longitudinal axis of the flexible strap with the first receiving element engaging the distal end.

3. The system of claim 1 wherein the single elongate sleeve is disposed on the proximal end substantially parallel to a longitudinal axis of the flexible strap with the second receiving element engaging the distal end.

4. The system of claim 1 wherein the single elongate sleeve incorporates a flap extending therefrom for attachment to the proximal end of the flexible strap.

5. The system of claim 4 further comprising a pivot pin securing the proximal end of the flexible strap to the flap.

6. The system of claim 1 wherein the first receiving element and the second receiving element comprise ladder lock buckles receiving the distal end of the flexible strap.

7. The system of claim 6 further comprising indicia proximate the first receiving element and the second receiving element annotating length of the distal end as received through the ladder lock buckles to achieve the first predetermined looped strap length and the second predetermined looped strap length.

8. The system of claim 1 wherein the first receiving element and the second receiving element comprise receiving buckles and the securing element comprises a blade received in the receiving buckles.

9. The system of claim 1 wherein the first receiving element and the second receiving element comprise side squeeze receiving buckles and the securing element comprises side squeeze tabs received in the side squeeze receiving buckles.

10. The system of claim 1 wherein the first receiving element and the second receiving element comprise a first moiety of a hook and loop fastener and the securing element comprises a mating moiety for the hook and loop fastener.

11. A method of using the system of claim 1 to restrain rotation of a rotatable latch arm to limit aircraft door position comprising:

engaging the single elongate sleeve attached to the proximal end of the flexible strap over the rotatable latch arm;

looping the distal end of the flexible strap through the loop eye on the cabin wall adjacent the aircraft door;

engaging the first receiving element with the distal end of the flexible strap establishing the first predetermined looped length of the flexible strap; and, restraining rotation of the rotatable latch arm beyond the second position.

12. The method of using the system of claim 1 to restrain rotation of a rotatable latch arm to limit aircraft door position as defined in claim 11 further comprising rotating the single elongate sleeve transverse to an axis of the flexible strap.

13. The method of using the system of claim 1 to restrain rotation of a rotatable latch arm to limit aircraft door position as defined in claim 11 further comprising:

alternatively engaging the second receiving element with the distal end of the flexible strap, establishing the second predetermined looped length of the flexible strap; and, restraining rotation of the rotatable latch arm from the first position.

14. The method of using the system of claim 1 to restrain rotation of a rotatable latch arm to limit aircraft door position as defined in claim 13 further comprising rotating the single elongate sleeve substantially parallel to the axis of the flexible strap.

15. The method of using the system of claim 1 to restrain rotation of a rotatable latch arm to limit aircraft door position as defined in claim 13 wherein the step of engaging the second receiving element comprises engaging the securing element in the second receiving element.

16. The method of using the system of claim 1 to restrain rotation of a rotatable latch arm to limit aircraft door position as defined in claim 15 wherein the second receiving element and the securing element are selected from the set of a buckle and blade, a side squeeze receiving buckle and side squeeze tabs, and a first moiety of a hook and loop fastener and a mating moiety for the hook and loop fastener.

17. The method of using the system of claim 1 to restrain rotation of a rotatable latch arm to limit aircraft door position as defined in claim 11 wherein the step of engaging the first receiving element comprises engaging the securing element in the first receiving element.

18. The method of using the system of claim 1 to restrain rotation of a rotatable latch arm to limit aircraft door position as defined in claim 17 wherein the first receiving element and the securing element are selected from the set of a buckle and blade, a side squeeze receiving buckle and side squeeze tabs, and a first moiety of a hook and loop fastener and a mating moiety for the hook and loop fastener.

* * * * *